US010010757B2

(12) United States Patent
Miklósi et al.

(10) Patent No.: US 10,010,757 B2
(45) Date of Patent: Jul. 3, 2018

(54) EQUIPMENT FOR IMPROVING PHYSICAL FITNESS

(75) Inventors: József Miklósi, Budapest (HU); Péter Soldos, Budapest (HU); Károly Füles, Budapest (HU)

(73) Assignee: Sparrowbag Hungary Kft., Budapest (HU)

( * ) Notice: Subject to any disclaimer, the term of this patent is extended or adjusted under 35 U.S.C. 154(b) by 558 days.

(21) Appl. No.: 13/811,967

(22) PCT Filed: Jul. 26, 2011

(86) PCT No.: PCT/HU2011/000078
§ 371 (c)(1),
(2), (4) Date: Jan. 24, 2013

(87) PCT Pub. No.: WO2012/013995
PCT Pub. Date: Feb. 2, 2012

(65) Prior Publication Data

US 2013/0123084 A1 May 16, 2013

(30) Foreign Application Priority Data

Jul. 27, 2010 (HU) ..... 1000400

(51) Int. Cl.
*A63B 21/06* (2006.01)
*A63B 26/00* (2006.01)
(Continued)

(52) U.S. Cl.
CPC ..... *A63B 26/00* (2013.01); *A63B 21/0603* (2013.01); *A63B 21/072* (2013.01); *A63B 2071/0694* (2013.01); *A63B 2209/10* (2013.01)

(58) Field of Classification Search
CPC ..... A63B 21/06; A63B 21/02; A63B 21/03; A63B 21/0607; A63B 21/072; A63B 21/0724; A63B 21/075; A63B 21/06
(Continued)

(56) References Cited

U.S. PATENT DOCUMENTS 2,023,682 A * 12/1935 Higginbottom ..... B65B 7/08 53/136.5
5,445,587 A * 8/1995 Brown ..... 482/108
(Continued)

FOREIGN PATENT DOCUMENTS

CN 2737410 Y 11/2005
CN 2882694 Y 3/2007
(Continued)

OTHER PUBLICATIONS https://www.youtube.com/watch?v=6Nu-KX8qrrY, published Sep. 22, 2009, last visited Mar. 7, 2017.*
(Continued)

*Primary Examiner* — Loan H Thanh
*Assistant Examiner* — Rae Fischer
(74) *Attorney, Agent, or Firm* — Jason D. Voight

(57) ABSTRACT

The invention discloses an equipment for improving physical fitness, whose primary aspect is muscle strengthening. Another objective of the invention, besides maximizing muscle development, is to minimize the risk of injury during and after practices. The invention has a comfortable, tailor-made design shell (1), filled with filling material. The shell (1) of the filler can be filled or emptied during exercises (in-situ method). The shell (1) does not have any strips or handles on its outer surface. The shell (1) size is designed in a way that its size matches the shoulder width of the user. In addition, the device is equipped with a scale (3), which indicates the charge status.

8 Claims, 3 Drawing Sheets

(51) Int. Cl.
*A63B 21/072* (2006.01)
*A63B 71/06* (2006.01)

(58) Field of Classification Search
USPC ..... 482/105, 108, 93, 109; D9/707–710; 383/2, 907
See application file for complete search history.

(56) References Cited

U.S. PATENT DOCUMENTS

| | | | | |
|---|---|---|---|---|
| 5,857,946 | A * | 1/1999 | Brown | 482/108 |
| 6,209,135 | B1 | 4/2001 | Irvin | |
| 2002/0034541 | A1 | 3/2002 | Valducci | |
| 2006/0093670 | A1 | 5/2006 | Mizushima | |
| 2013/0138021 | A1 * | 5/2013 | Mikesell | A63B 21/4035 601/40 |

FOREIGN PATENT DOCUMENTS

| | | | |
|---|---|---|---|
| CN | 201186126 | Y | 1/2009 |
| EP | 0 134 047 | A1 | 3/1985 |
| RU | 2067470 | C1 | 10/1996 |

OTHER PUBLICATIONS http://www.dictionary.com/browse/lemniscate, last visited Mar. 7, 2017.*
http://whatis.techtarget.com/definition/lemniscate, last visited Mar. 7, 2017.*

* cited by examiner

EQUIPMENT FOR IMPROVING PHYSICAL FITNESS

This is the national stage of International Application PCT/HU2011/000078, filed Jul. 26, 2011.

The subject of this invention is a piece of equipment that is aimed at improving and keeping physical fitness. The invention is primarily used in various fields of sport. However, it can also be used in all activities and areas that aim to increase, improve and exercise muscles, including physical rehabilitation, creating and developing motoric skills, such as improving balance or posture in the physical development of children.

The invention is based on the recognition that people do not use all muscle groups the same intensity, consequently certain muscle groups may regress or develop abnormally. The equipment offers a solution to such issues, by exercising and developing muscle groups that are not typically used in everyday activities.

Our experiments showed that solid but liquid-like substance loaded in a flexible shell is the most appropriate solution for this purpose. It is vital that the filling material within the flexible shell should have both liquid and solid characteristics. The shell is best as a bag. The filling material of the shell may be sand, various granules, liquid, sawdust, metal powder, etc. Our experiments show that using liquids such as water, as a filling material, results in losing vital qualities in muscle development, in comparison with other fillers, such as sand. For example, a water-filled shell was unsuitable for the strengthening one's grip.

The shell material must be made of a waterproof/water resistant material in order to keep the flowing, but solid filling material within the shell.

Currently, sand-filled bags are is several cases used for muscle development purposes. One of such products is the Reebok Powerbag, which is a cylinder-shaped bag, with moving sand inside and handles on the outside. The product operated by the moving sand, as it shifts from one end to another in the bag.

This motion can easily damage the muscles, and the handles located on the surface of the bag handles are further potential sources of injury, as the users' fingers may be caught on the handles. The bag weight is set to a predetermined value, which cannot be change in an in situ manner.

The shape of the bag we have developed is significantly different from that of typical sand-filled bags, because it was designed to perform physical exercises. This is reflected in a lemniscate-shaped design.

The decision to use a lemniscates-shape bag design is a result of the finding that this shape offers the most efficient muscle work of the individual body parts.

The surface of the shell is designed in a way that it offers no easy grip, consequently the user can use this device for a wide range of purposes from strengthening of the grip to weight-lifting.

A Chinese Utility Model (under document number CN 201186126Y) presents a similarly shaped sandbag which can be used for sport purposes, however, in that case, sand is filled into an inner bag, which is placed into a similarly shaped outer bag. The weight of sand has a predetermined value and the weight of sand cannot be changed during workout (in situ). Furthermore, the size of the sport equipment is not specified, so without knowing the exact weight and size it is a problem to decide who exactly can use it, as such specifics differ for children, adult males and females.

Application CN 2737410 Y (Chinese Utility Model) is also presenting equipment for sporting purposes. Its shape is similar and is made of elastic material with grooves located at least on one side. The bag can both be filled with metal powder or sand. They argue that bag is easy to use. The weight of sand, however, cannot be changed during workout (in situ) and in this case it is also not possible to decide what group users can use it safely, as product specifics should differ for children, adult, males and females.

In addition, the design of this tool alone does not fulfill the set of conditions that we developed—based on our experiments—to improve the efficiency of muscle strengthening. For example, grooved, flexible and flat surfaces behave differently than a uniform surface shell, because the method of gripping is completely different from our standards. Our objective for gripping dictates that no surface or surface formation should help the gripping of the user. Furthermore, the grooved flexible material gives an entirely different stiffness of the equipment. For example if both sides of equipment are grabbed then the center line of the equipment bends takes a curved shape, another feature against our research objectives.

Our invention provides a solution for all such shortcomings. The shell has an opening through which the filling material can be loaded to the ideal weight (for example 5-8, 8-12, 12-20, 20-32 or 32-45 kg). Thorough the same opening the shell can also be emptied. In our experiments we found that the actual size of the shell state is best when at least half full.

If the filler quantity in the shell is under the half load that the efficiency of the exercises drops. If the load is under 50% of the total capacity of the shell the feasibility as well as the efficiency of the exercises is lower. We have also created a solution for an easy checking of the loading level. The solution originates in the lemniscates shape of the shell. If the shell is stood on the half-lemniscates side, which has no opening, using the scale that is along the length of the equipment it is easy to determine the weight of the filling material. The scale's range increases towards the opening. To achieve the best equipment shape it is advised to use sand, the scale is optimized for the characteristics of this material, however it can also be used for any above mentioned filler.

The invention also provides solution to the problem whether a child, a male or female adult wishes to use the equipment. Based on experiments we found that the equipment should be selected to the user's own shoulder width.

This means that the distance between the farthest points on the lemniscates distance is and should be shoulder width.

If the user lowers its arms in shoulder width so that the forearms and upper arms are in right angle to each other close to the body, while the open palms are facing upwards and the palms are located under the maximum widths of the lemniscates shape.

This position also determines the balance position of the bag, and helps to check if both sides of the bag have an even amount of filling. This method can also be used to check and change the distribution of weight of the filling, in order to minimize the possibility injury during exercise and maximize muscle development.

The invention is presented by the following figures.

FIG. 1: The lemniscate shaped shell and the scale on the shell.

FIG. 2: The lemniscate shaped shell with the filling opening.

FIG. 3: The longitudinal side view of the lemniscate shaped shell of.

FIG. 4: The shorter side view of the lemniscate shaped shell.

FIG. 5: Pattern of one half of the lemniscate shaped shell.

FIG. 6: The pattern of the other half of the lemniscate shaped shell.

The lemniscate shaped 1 shell displayed in FIG. 1, has a 3 scale mark which is parallel with the equipment's longitudinal axis. The 3 scale mark is to assist the user to identify the exact weight of the filling in the lemniscate shaped 1 shell. This can be achieved by standing the equipment on the half-lemniscates side that has no opening, and by reading the scale that is along the length of the equipment it is easy to determine the weight of the filling material. The weight depends on the specific weight of the used filler.

The lemniscate shape 1 shell has two maximum 4 widths. The 6 distance of these two maximum 4 widths is equal to the shoulder width of the user.

We found in our experiments that the shoulder width of the user must to be set to the two maximum 4 width of the 6 distance of the lemniscate shape 1 shell in order to maximize physical development and minimize the risk of injury.

In FIG. 2, we can see the 2 opening of the 1 shell, which is shaped to be suitable for both filling and emptying filler. The two-dimensional image of the shape of the 2 opening can be square-like or trapezoidal, but is not limited to these geometric configurations. One of the most ideal shapes for the 2 opening is an inverse truncated cone with a decreasing diameter towards the inside of the 1 shell.

In theory, the 1 shell 2 opening can be placed anywhere on the 1 shell, but ideally should be located be on the maximum 4 width of any part of the 1 shell to be in line with the results of our experimental findings. In other words, the 2 opening is located between the end point of the longitudinal axis of the lemniscate shape 1 shell and the maximum 4 width corresponding to the end point of the same axis. The optimal location of the 2 opening is between at least ⅔ part of the longitudinal axis and remaining ⅓ part of longitudinal axis of the lemniscate shaped 1 shell. The 2 opening is designed to hide in the surface of the 1 shell, in a way that the 2 opening can be hidden under the 5 cover edge by zigzag folding. The hiding design is not limited only to this solution. The folding rate depends on how long we chose the geometric center axis of the 2 opening. We can close the 2 opening by several different securing methods, for example Velcro, clamp joint, button, but the design of the locking of the 2 opening is not limited to only these solutions. Furthermore, we can achieve air-proof locking with Velcro on the zigzag folded 2 opening under the 5 cover edge to prevent the filler material's outflow during training.

We can see the side view in FIG. 3, where the 1 shell is the thickest at the two maximal 4 width and the smallest symmetry axis of the 1 shell is the thinnest if the lemniscate-shaped 1 shell is filled to the allowed maximum value. The maximum allowed value always depends on who is using the equipment (child, male adult or female adult) as well as on their shoulder width.

FIG. 4 clearly shows, if the 1 shell is set at maximum allowed value, it takes an elliptical shape.

Figure 1:
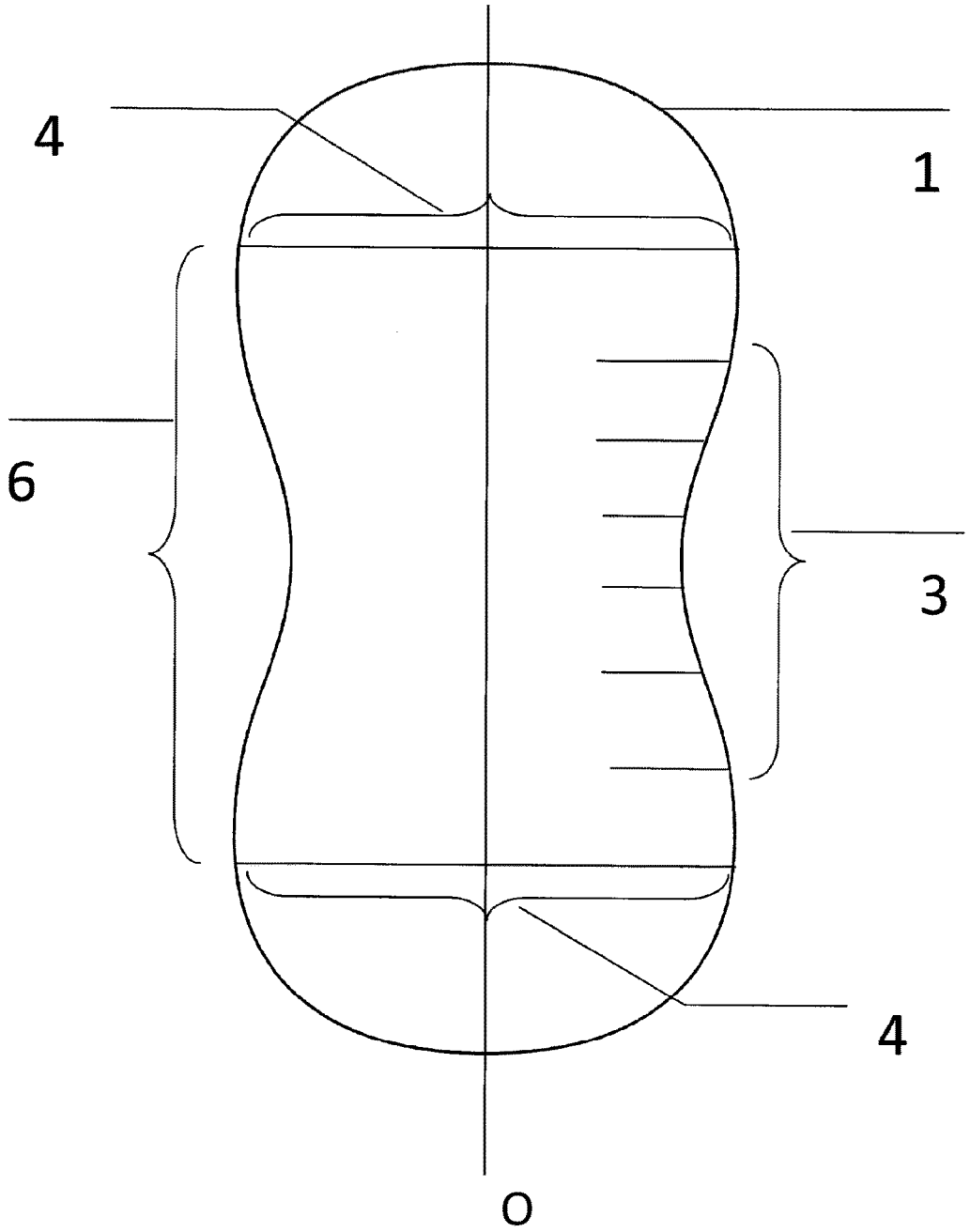
Figure 2:
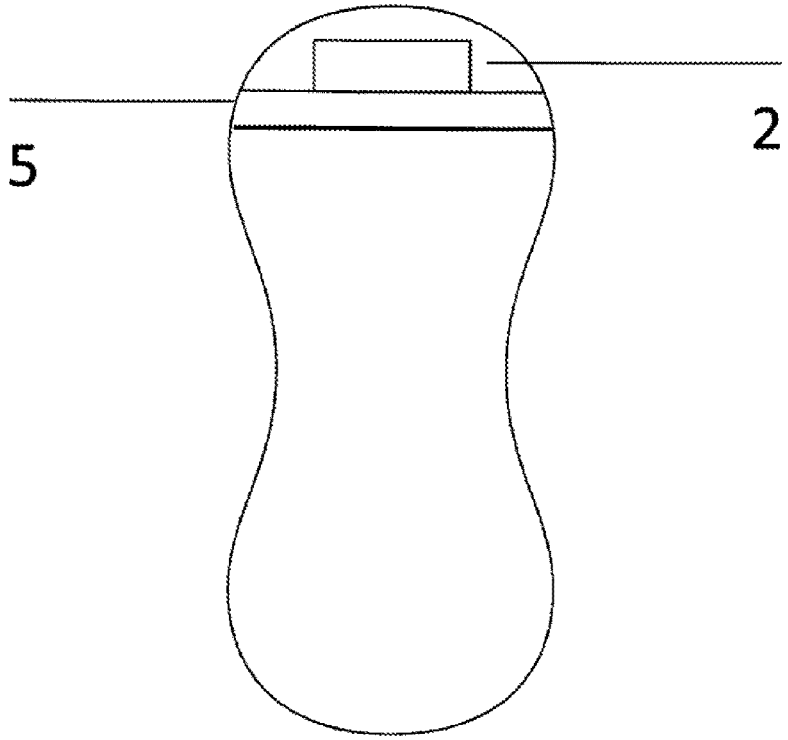
Figure 3:
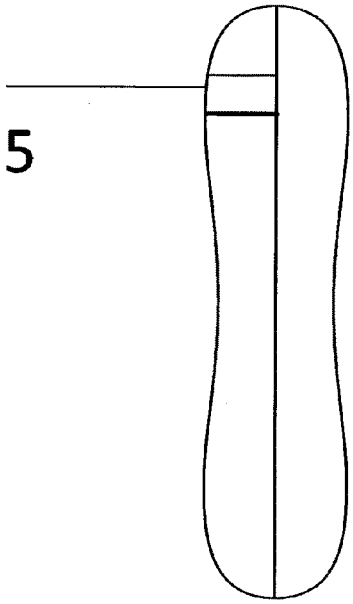
Figure 4:
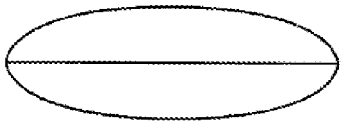
FIG. 4 shows one of the profiles of the lemniscate shaped 1 shell.
Figure 5:
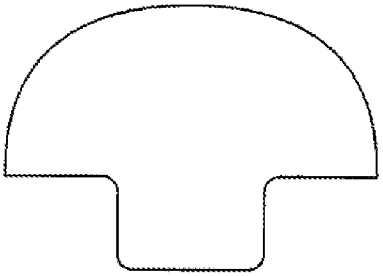
FIG. 5 shows the pattern of the 2 opening and one end of the 1 shell.
Figure 6:
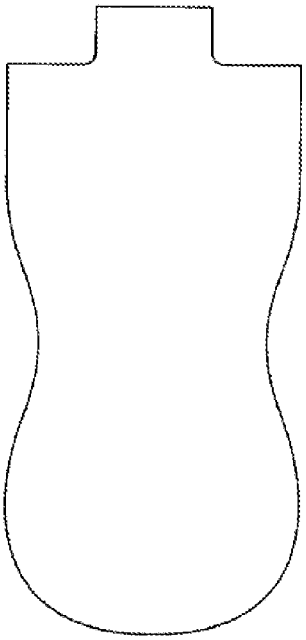
FIG. 6 shows the pattern of the greater part of 1 shell and the 2 opening.

The advantages of the invention are the following. We can (in situ) change the weight of the physical fitness improving equipment though the opening, consequently we do not need a complete weight set or a set of different weight sandbags. The size of physical fitness improving equipment is tailored to the user, in each case, in such a way that size of the device is matching the user's shoulder width. Consequently, the possibility of injuries originating from working with unwanted weights can be reduced. The opening is hidden in the surface of the shell, which further reduces the risk of injury. Furthermore the weight of the equipment can be determined in an easy way, by using the scale on its shell.

Simple design, inexpensive production, easy and safe usage, easy storing.

The invention claimed is:

1. An equipment for improving physical fitness of a user, comprising a flexible and uniform shell configured to receive a filler material, the shell having:

a surface free of any formation to help the gripping of the user;

an opening formed in the surface; and a shape contour, prior to filling, of a lemniscate, wherein the lemniscate is defined by a longitudinal axis of symmetry, two maximum width portions measured at right angles to the longitudinal axis and separated from each other by a narrower central portion, wherein the opening of the shell is configured to be hidden in and integral with the surface of the shell, and wherein the opening is configured to be covered by a portion of the shell after filling.

2. The equipment according to claim 1, wherein the opening of the shell is designed to allow changing the weight of the equipment by the user by loading a filler material into the shell or emptying the filler material from the shell.

3. The equipment according to claim 1, wherein the opening of the shell is located between an end point of the longitudinal axis of the lemniscate shape contour and one of the maximum widths.

4. The equipment according to claim 1, wherein the opening (2) of the shell (1) is sealable in an airtight manner.

5. The equipment according to claim 1, wherein the shell (1) has a scale (3) with marks on the surface.

6. The equipment according to claim 5, wherein said scale (3) is provided along the longitudinal axis of the lemniscate shape contour and the marks of said scale (3) correlate with the weight of the equipment.

7. The equipment for improving physical fitness according to claim 1, wherein said shell (1) contains the filler material inside, said filler material being provided in the form of a flowing but solid filling material.

8. The equipment according to claim 7, wherein the flowing but solid filling material is chosen from the group consisting of sand, sawdust and metal powder.

* * * * *